US006945421B2

(12) United States Patent
Phifer

(10) Patent No.: US 6,945,421 B2
(45) Date of Patent: Sep. 20, 2005

(54) SILVERWARE BASKET WITH TIERED COMPARTMENTS

(75) Inventor: Robin K. Phifer, Jackson, TN (US)

(73) Assignee: Maytag Corporation, Newton, IA (US)

( * ) Notice: Subject to any disclaimer, the term of this patent is extended or adjusted under 35 U.S.C. 154(b) by 459 days.

(21) Appl. No.: 10/142,188

(22) Filed: May 9, 2002

(65) Prior Publication Data

US 2003/0209548 A1 Nov. 13, 2003

(51) Int. Cl.[7] ..... B65D 21/02

(52) U.S. Cl. ..... 220/486; 220/505; 220/487; 220/488

(58) Field of Search ..... 220/505, 23.83, 220/23.86, 23.87, 488, 487, 486, 503, 507, 501, 555; 211/41.3, 41.8, 41.9

(56) References Cited

U.S. PATENT DOCUMENTS

| | | | | | |
|---|---|---|---|---|---|
| 320,266 | A | * | 6/1885 | Maesel | 217/122 |
| 2,671,239 | A | * | 3/1954 | Wisner | 15/260 |
| 2,936,898 | A | * | 5/1960 | Miguez | 211/41.3 |
| D202,569 | S | | 10/1965 | Maslow | |
| D204,076 | S | | 3/1966 | Maslow | |
| 3,665,943 | A | | 5/1972 | Lampman et al. | |
| 3,960,290 | A | * | 6/1976 | Yake et al. | 220/835 |
| 4,157,145 | A | | 6/1979 | Jordan | |
| D287,175 | S | | 12/1986 | Gecchelin | |
| 4,761,008 | A | * | 8/1988 | Huggins | 273/148 R |
| 4,834,125 | A | * | 5/1989 | Insalaco | 134/201 |
| 5,069,360 | A | | 12/1991 | Dingler et al. | |
| 5,205,419 | A | | 4/1993 | Purtilo | |
| 5,431,294 | A | * | 7/1995 | Stottmann et al. | 220/23.4 |
| 5,462,348 | A | | 10/1995 | Ellingson et al. | |
| 5,485,927 | A | * | 1/1996 | Hubbard | 211/41.3 |
| D391,696 | S | | 3/1998 | Bournay, Jr. et al. | |
| 5,881,906 | A | | 3/1999 | Rogers et al. | |
| 6,109,435 | A | * | 8/2000 | Failor | 206/373 |

FOREIGN PATENT DOCUMENTS

| | | |
|---|---|---|
| JP | 10108819 A | 4/1998 |

* cited by examiner

*Primary Examiner*—Stephen Castellano
(74) *Attorney, Agent, or Firm*—McKee, Voorhees & Sease, PLC; Allan P. Orsund

(57) ABSTRACT

A silverware basket is provided for a dishwasher rack having a sloped bottom. The basket includes a plurality of compartments which are vertically tiered with respect to one another, such that the bottom of the basket matingly fits along the bottom of the rack. A handle is provided on the basket for easy removal and installation of the basket.

7 Claims, 5 Drawing Sheets

SILVERWARE BASKET WITH TIERED COMPARTMENTS

BACKGROUND OF THE INVENTION

Dishwasher racks come in a variety of configurations, but generally are of a wire-type construction. In older style racks, the bottom of the rack is flat or horizontal. In newer style racks, the bottom typically includes a plurality of sloped portions which are stair-stepped with respect to one another. The sloped bottom walls allow glasses and cups to be positioned in a tilted orientation, such that rinse water drains from the bottom of the cups and glasses, which are upwardly directed. Conventional silverware or utensil baskets are flat-bottomed, and thus do not nest neatly in such sloped-bottom racks.

Therefore, a primary objective of the present invention is the provision of an improved silverware basket for a dishwasher rack having a sloped or stair-stepped bottom.

Another objective of the present invention is the provision of a silverware basket having tiered compartments.

A further objective of the present invention is the provision of a silverware basket having multiple compartments positioned at different vertical elevations with respect to one another.

These and other objectives will become apparent from the following description of the invention.

BRIEF SUMMARY OF THE INVENTION

The silverware or utensil basket of the present invention includes a plurality of compartments defined by upright walls and bottom walls. The bottom walls are vertically offset with respect to one another such that the compartments are tiered, or at different elevations. The tiered compartments accommodate a sloped or stair-stepped bottom wall of a dishwasher rack such that the basket fits properly in the rack. The compartments share a common dividing wall. A handle is provided on the basket to facilitate removal of the basket from the rack. The compartments are integrally formed with one another.

DETAILED DESCRIPTION OF THE INVENTION

Figure 5:
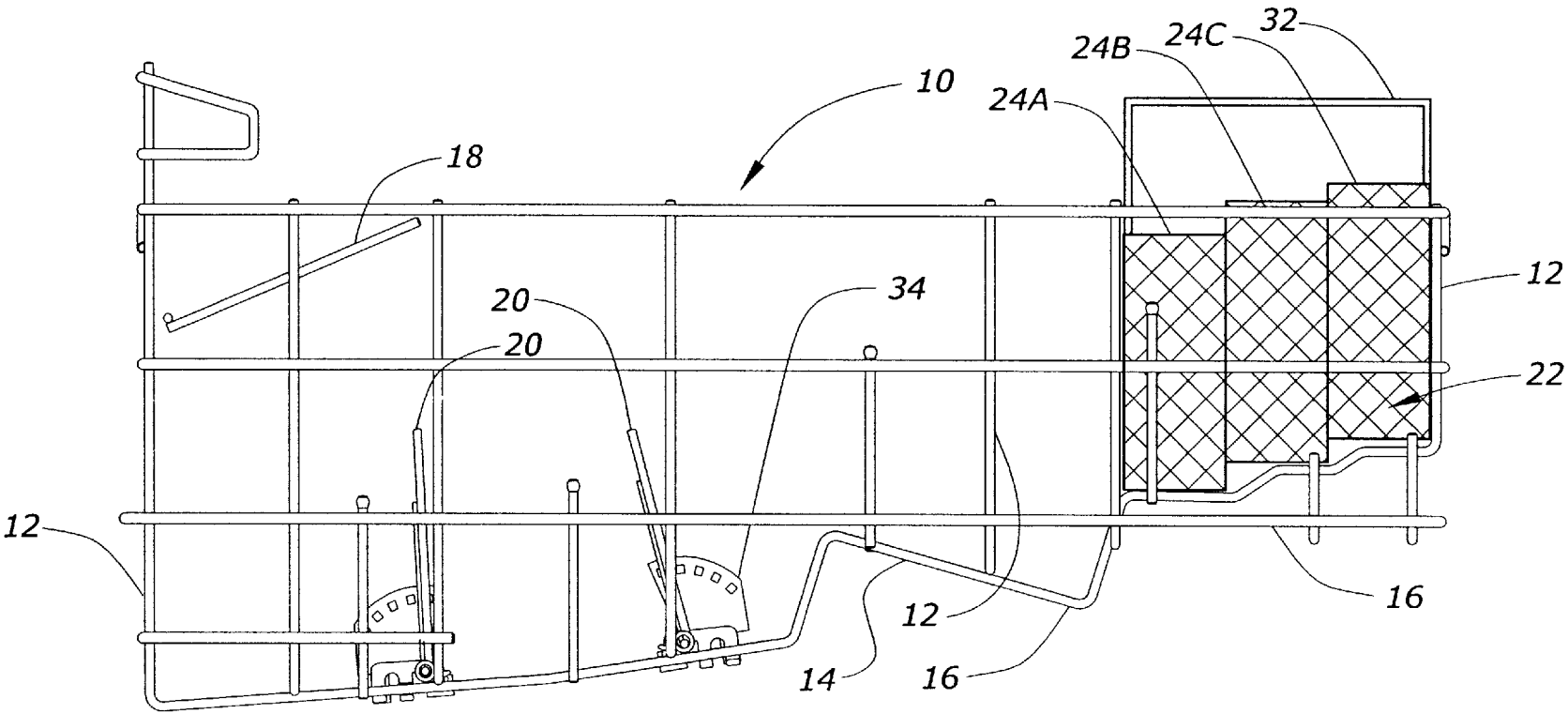
FIG. 5 is a side elevation view showing the silverware basket installed in a dishwasher rack having a sloped bottom.

The reference numeral 10 generally designates a conventional dishwasher rack for use in a dishwasher. The rack 10 may be located anywhere within the dishwashing compartment, that is, the rack 10 may be an upper rack, a lower rack, or a middle rack. The rack 10 includes upright walls 12 and a bottom 14. As seen in FIG. 5, the bottom 14 includes sloped or stair-stepped portions 16. The rack 10 may also include a cup shelf 18 and a plurality of tines 20 which may be fixed or adjustable.

The structure of the rack 10 is conventional and does not constitute a part of the present invention.

The present invention is directed towards a silverware or utensil basket 22 which is adapted to be installed or nest in the rack 10. The basket 22 includes a plurality of step tiered compartments 24A, 24B, 24C. The compartments are defined by upright walls 26. Each compartment 24A, 24B, 24C, is provided with a bottom 28A, 28B, 28C and have open upper ends or tops 30A, 30B, 30C.

Figure 1:
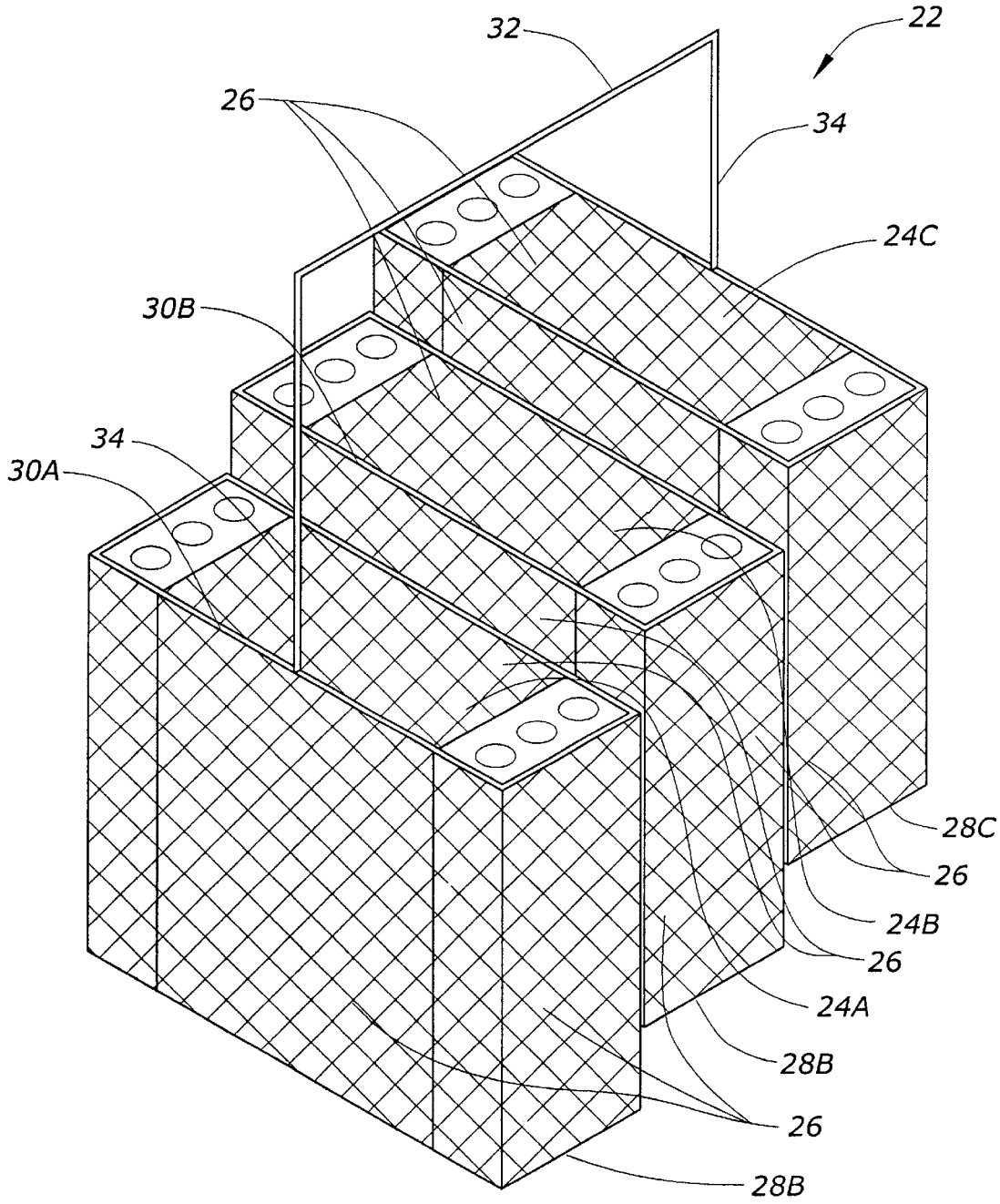
FIG. 1 is a perspective view of the silverware basket of the present invention.
Figure 2:
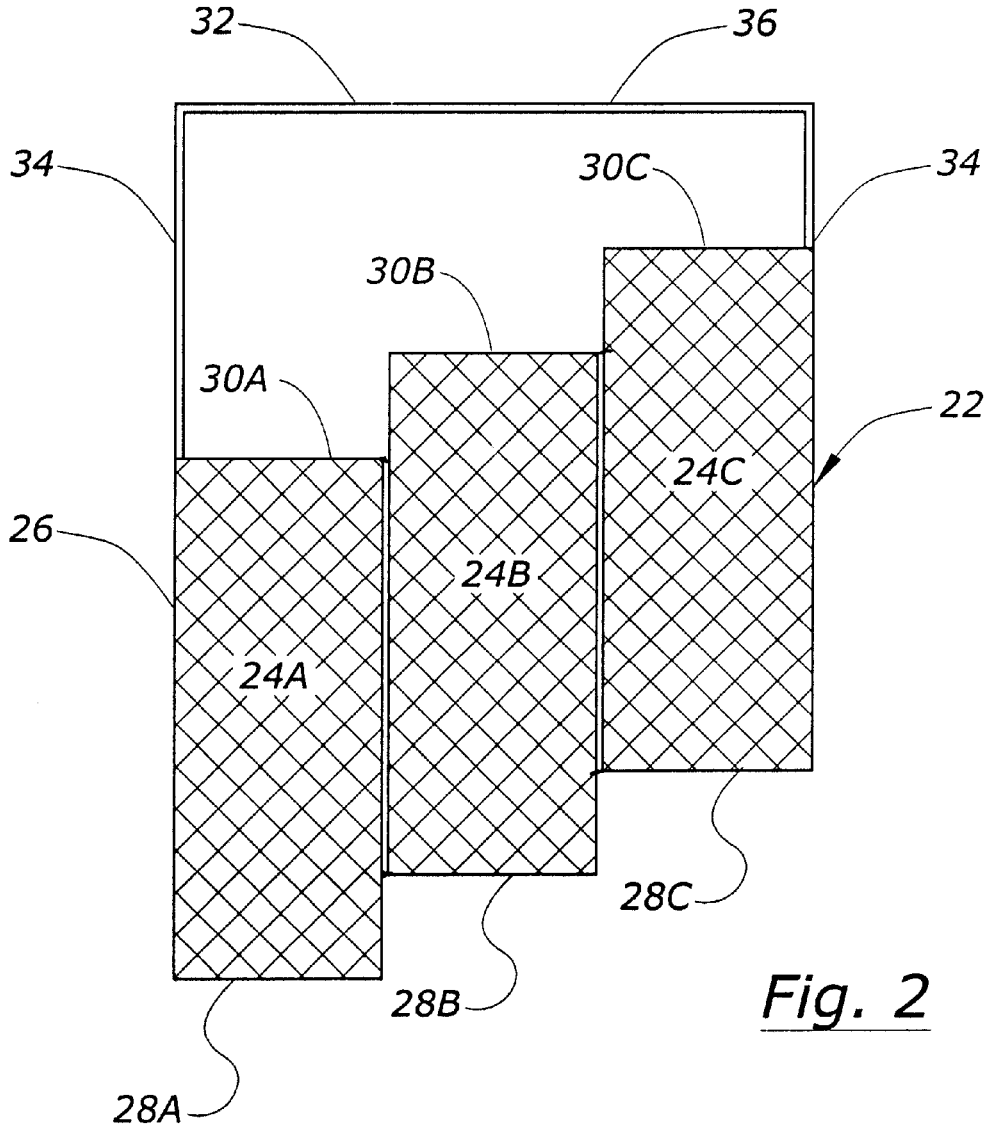
FIG. 2 is a side elevation view of the silverware basket of the present invention.

As best seen in FIGS. 1 and 2, the step tiered compartments 24A, 24B, 24C are vertically offset with respect to one another by a rise of a step, such that each compartment is at a different elevation. The offset bottoms 28A, 28B, 28C have bottom surfaces that contact the bottom of the rack thus allow the basket 22 to fit neatly along the sloped bottom portion 16 of the rack 10, as shown in FIG. 5.

Figure 3:
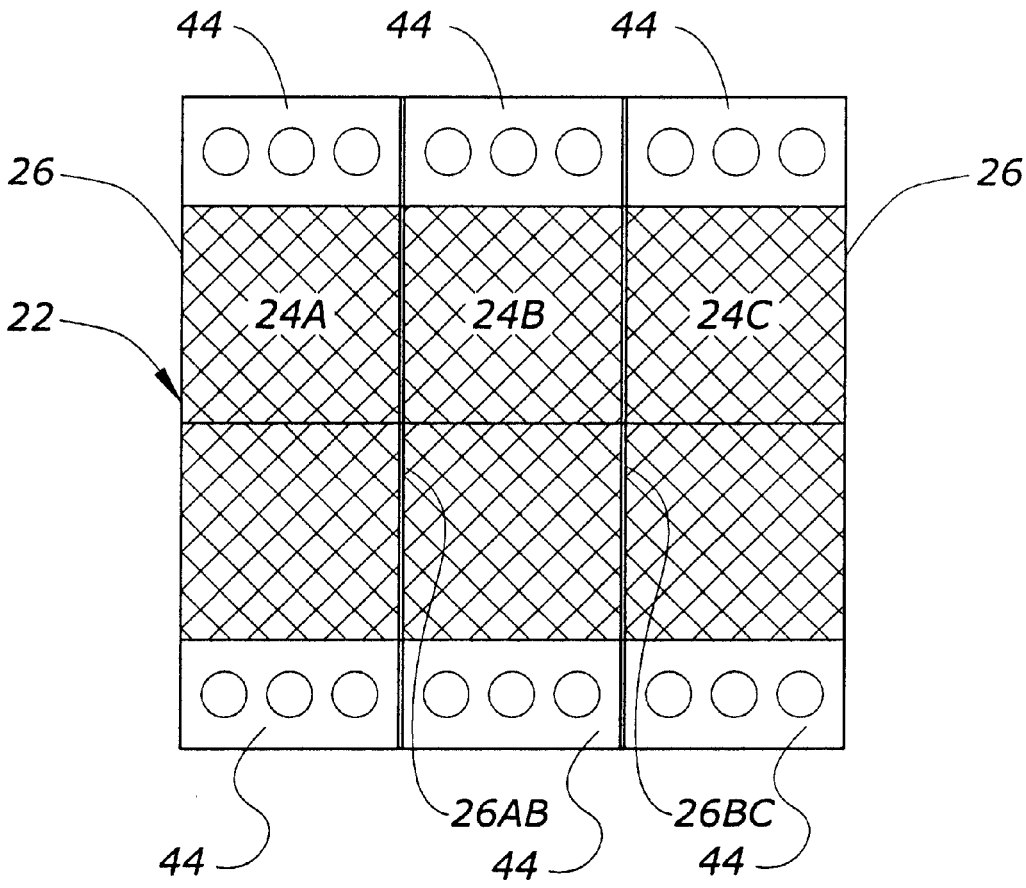
FIG. 3 is a top plan view of the silverware basket of the present invention.
Figure 4:
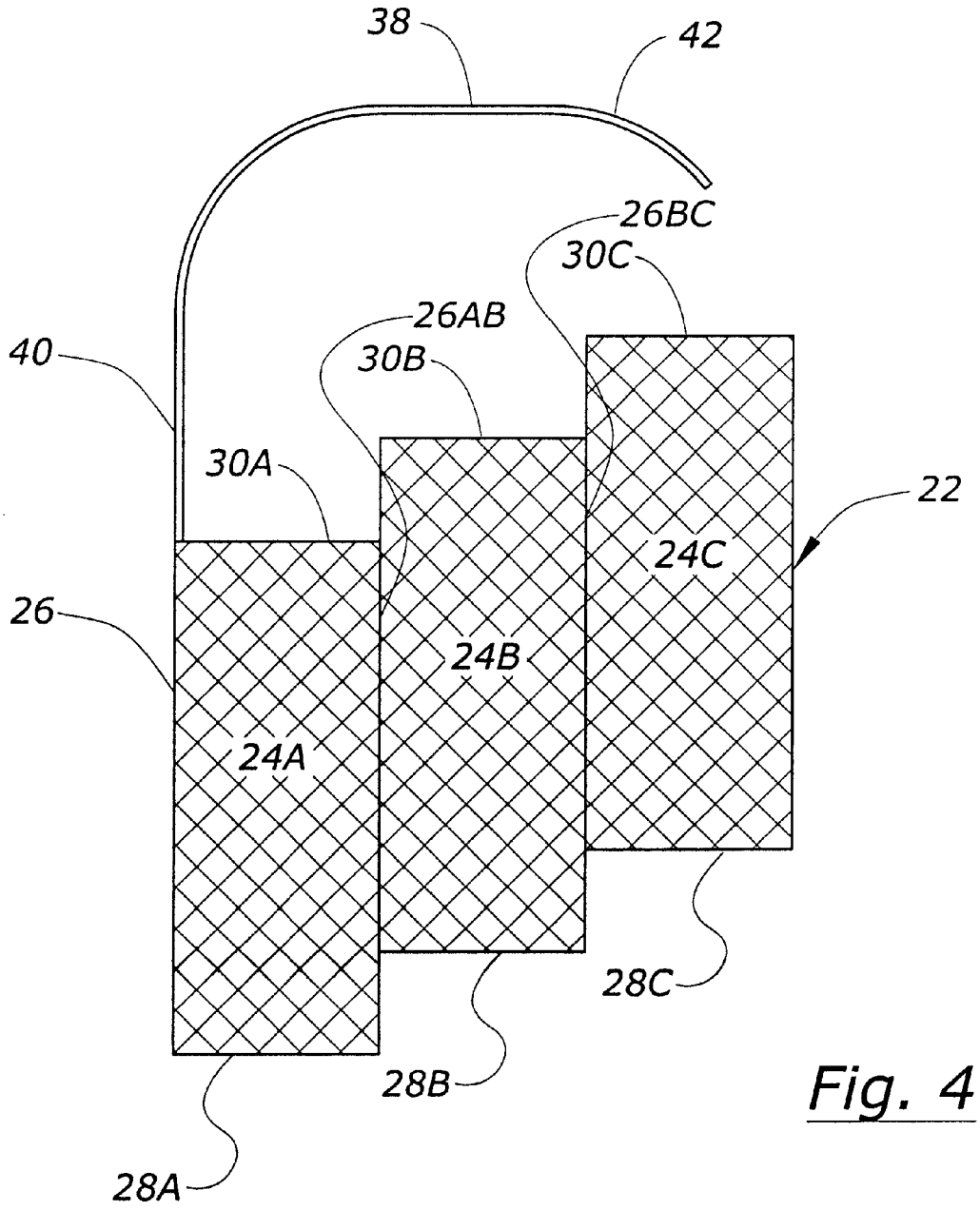
FIG. 4 is a view similar to FIG. 2 showing an alternative embodiment of a molded basket with a curved handle.

The basket 22 is provided with a handle 32, which includes legs 34 extending upwardly from the outermost walls 26, with an inner connecting grip 36. In one embodiment, the compartments 24A, 24B and 24C are defined by separate baskets which snap fit together, as seen in FIGS. 1 and 3. The individual baskets may be separately placed in the rack 10. Alternatively, the compartments 24A, 24B, 24C may be molded as a single unit. In the molded embodiment, the compartments 24A, 24B share a common wall 26AB, while the compartments 24B, 24C, share a common wall 26BC, as shown in FIG. 4. In an alternative configuration, as shown in FIG. 4, a handle 38 includes a single leg 40 which is connected to one of the walls 26 and is curved upwardly to terminate in a grip portion 42.

If desired, the compartments 24A, 24B, 24C can be subdivided to provide separate sections 44 for certain utensils, such as sharp knives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A silverware basket for a dishwasher rack, the rack having a sloped bottom, the basket comprising:

first and second step tiered compartments each have a bottom outer surface, the bottom outer surface of the compartments being vertically offset with respect to one another by a rise of the step such that the basket accommodates the slope of the rack bottom, the bottom outer surface of the first compartment contacts the rack bottom at a higher position than the bottom outer surface of the second compartment when the rack is in an upright position;

the basket including upright walls to support silverware in a substantially upright orientation; and the upright walls being substantially vertical when the basket is mounted in the rack.

2. The basket of claim 1 wherein each compartment has an open top for receiving silverware, the tops being vertically offset with respect to one another.

3. The basket of claim 1 wherein the compartments share a common wall.

4. The basket of claim 1 further comprising a handle connected to at least one of the compartments.

5. The basket of claim 4 wherein the handle has opposite ends connected to each of the compartments.

6. The basket of claim 1 further comprising a third tiered compartment having a bottomouter surface offset with respect to the bottomouter surface of the first and second compartments.

7. The basket of claim 1 wherein the compartments are integrally formed with one another.

* * * * *